United States Patent [19]

Cleary

[11] Patent Number: 4,491,369

[45] Date of Patent: Jan. 1, 1985

[54] CREATION OF FLOW BARRIERS AND GROUND ISOLATION BY BLOCK DISPLACEMENT

[76] Inventor: James M. Cleary, 92 McCallum Dr., Box 541, Falmouth, Mass. 02541

[21] Appl. No.: 445,904

[22] Filed: Dec. 1, 1982

[51] Int. Cl.[3] ..... E21C 41/00

[52] U.S. Cl. ..... 299/19; 166/280; 166/308

[58] Field of Search ..... 166/280, 281, 308; 299/11, 2, 16, 19; 405/138, 258

[56] References Cited

U.S. PATENT DOCUMENTS

| | | | |
|---|---|---|---|
| 703,302 | 6/1902 | Pratt | 299/13 |
| 2,104,579 | 1/1938 | Bennett | 299/16 |
| 2,547,778 | 4/1951 | Reistle, Jr. | 405/57 |
| 3,917,349 | 11/1975 | Cleary, Jr. | 299/13 |
| 4,175,490 | 11/1979 | Britton et al. | 299/2 |
| 4,230,368 | 10/1980 | Cleary, Jr. | 299/2 |

*Primary Examiner*—George A. Suchfield
*Assistant Examiner*—William P. Neuder
*Attorney, Agent, or Firm*—Herbert L. Bello

[57] ABSTRACT

A method for isolating an earth mass and for setting up barriers to ground water flow by displacing the earth block and injecting sealant into the separations under and around the block, the sealant, acting as a working fluid to displace the earth block. In one embodiment, the displacement process is aided by sealing the upper perimeter of the block. In another embodiment, earth blocks are displaced in a progressive manner where a region of active vertical displacement advances around the perimeter of a region to be isolated. In a further method, an earth block is separated at its base and partially displaced upward before the sides of the block are separated.

5 Claims, 9 Drawing Figures

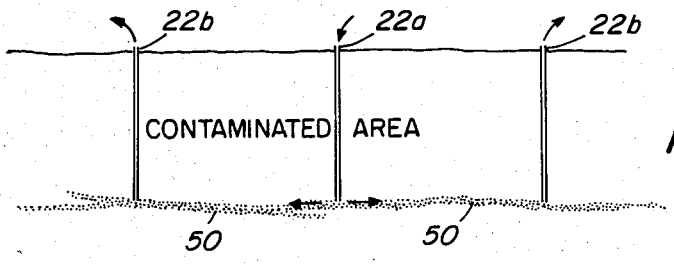
FIG. 6
FIG. 7
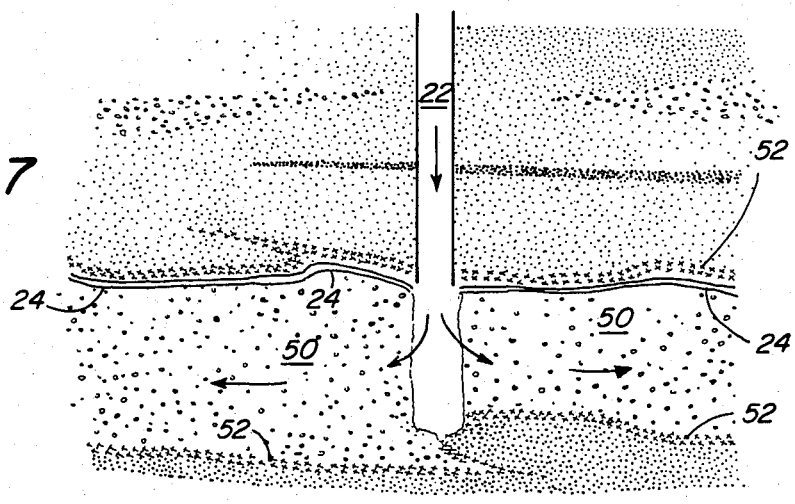
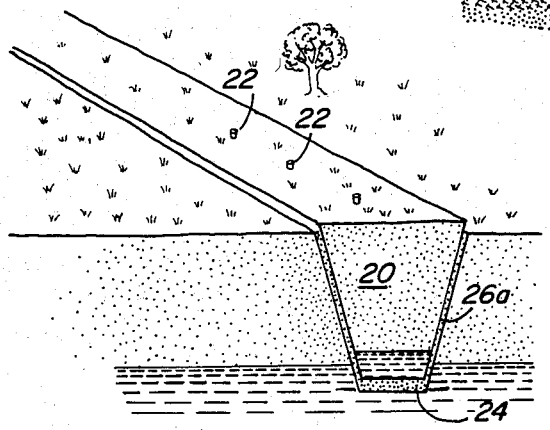
FIG. 8
FIG. 9
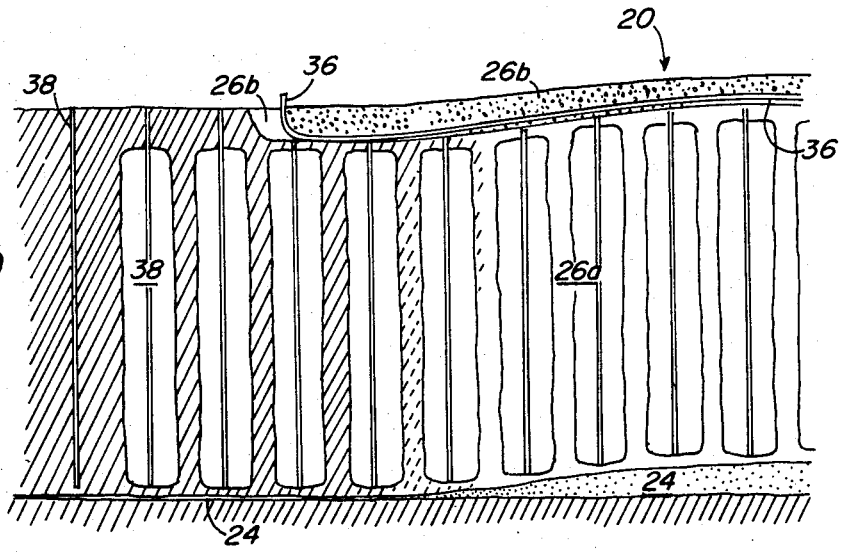

CREATION OF FLOW BARRIERS AND GROUND ISOLATION BY BLOCK DISPLACEMENT

BACKGROUND OF THE INVENTION

1. Field of the Invention

The present invention relates to earth block displacement methods and, more particularly, is directed toward methods for isolating masses of contaminated earth and establishing ground water flow barriers.

2. Description of the Prior Art

Isolation of underground chemical waste contamination from groundwater systems is a major national need. This contamination, which threatens groundwater supplies at many locations throughout the country, results from chemical spills, chemical waste dumps, and inadequately lined storage lagoons. Variations in geologic setting and geometry of some contaminated regions needing containment require special techniques for the isolation process.

In U.S. Pat. No. 4,230,368 methods are set forth for displacing a very large block of earch by creating separations around the sides and bottom and displacing the earth mass by fluid injection. U.S. Pat. No. 4,230,368 discloses a broad range of applications for the earth block displacement process in mining underground storage and in situ recovery of hydrocarbons.

SUMMARY OF THE INVENTION

It is an object of the present invention to provide methods of earth block displacement.

It is another object of the present invention to provide methods for isolating a contaminated earth mass and the setting up of barriers to ground water flow. In these methods, the separations created by block displacement are filled with sealant to form impermeable barriers.

Yet another object of the present invention is to provide methods for affecting the block displacement to create isolation barriers in the setting typical of chemically contaminated earth masses requiring isolation. Typical characteristics of such contaminated earth masses are:

(a) poorly consolidated or unconsolidated sediments;
(b) highly permeable sands and gravels;
(c) a contaminated region whose horizontal dimensions are large compared with its depth; and
(d) hard irregularly fractured basement under unconsolidated sediments.

A further object of the present invention is to provide a method for containing the displacement pressure in order to create a more efficient distribution of pressure to stabilize the block during its initial displacement when the earth section is highly permeable and unconsolidated, and to provide methods for isolating contaminated areas having very large horizontal extent.

The present invention discloses methods for isolating an earth mass and for setting up barriers to ground water flow. In a specific embodiment, the earth mass to be isolated is contaminated with toxic waste. Separations are created by the steps of displacing the earth block, injecting sealant into the separations under and around the block. The sealant, which is injected through wells, acts as a working fluid to displace the earth block. The displacement process is aided by sealing means installed around the upper perimeter of the block. In cases where the base of the block is separated in highly permeable sands and gravels, a special fluid is used to introduce permeability stratification to contain the pressure needed to displace the block. In other methods of the invention, earth blocks are displaced in a progressive manner where a region of active vertical displacement advances around the perimeter. In a further method, the contaminated region is separated at its base and partially displaced upward before the sides of the region are separated.

Other objects of the present invention will in part be obvious and will in part appear hereinafter.

The invention accordingly comprises the processes, together with their steps and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 6 is a cross-sectional view of a contaminated region showing injection into a selected zone of separation;

FIG. 7 is a cross-sectional view showing injection into a selected zone of separation and intergranular filter cake;

FIG. 8 is a cross-sectional view showing separation of the marginal area of an earth mass to be isolated; and FIG. 9 is a cross-sectional view in the plane of separation showing progressive displacement.

DETAILED DESCRIPTION OF THE PREFERRED EMBODIMENTS

In the following description of the present invention, the term "sealant" refers to a working fluid which is used to displace a massive block of earth, the sealant subsequently becoming an impermeable barrier wall in the space created by block displacement. The sealant may contain a wide range of ingredients including sodium bentonite, gelled asphalt, carboxymethyl celulose and other polymers. Usually the sealant will be composed in major part of the common soil materials, sand, silt and clay. Refined sodium bentonite clay and water may be added to these to form a commonly used sealant composition. The bentonite addition will normally be in the range 40 to 70 kg/m$^3$ (2.5 to 4.4 lb/ft$^3$) with the soil component amounting to 1000 to 1500 kg per cubic meter of sealant. Other materials may be mixed with soil to form sealant compositions, for example, gelled asphalt.

Important sealant qualities during block displacement include gel strength and the ability to form low permeability filter cake on permeable soil materials. Gel strength is a measure of the shear stress required to initiate and maintain flow. For ordinary Newtonian liquids such as water or honey the gel strength is zero. Gel strength is also a measure of the ability to form stable suspensions of particles.

Another term used in the following description is "low leak-off" fluid. This term is frequently used with reference to drilling muds. A low leak-off fluid has the ability to form a filter cake having very low permeability. The sealants discussed above are examples of low leak-off fluids. A low solids low leak-off fluid may be made by mixing 2% bentonite and 0.2% carboxymethyl celulose (CMC) in a water suspension. The filter cake formed by this mixture can have a permeability of roughly $10^{-8}$ cm/sec. Low solids, low leak-off water based fluids are important in the methods of the present invention in initial stages of block displacement.

Bentonite, CMC, guar gum, starch, and various other colloids are used to control leak off and are termed 'leak-off control agents' in drilling mud terminology. The same meaning applies in the present discussion and these materials might all find use as leak-off control agents in the present invention.

Figure 1:
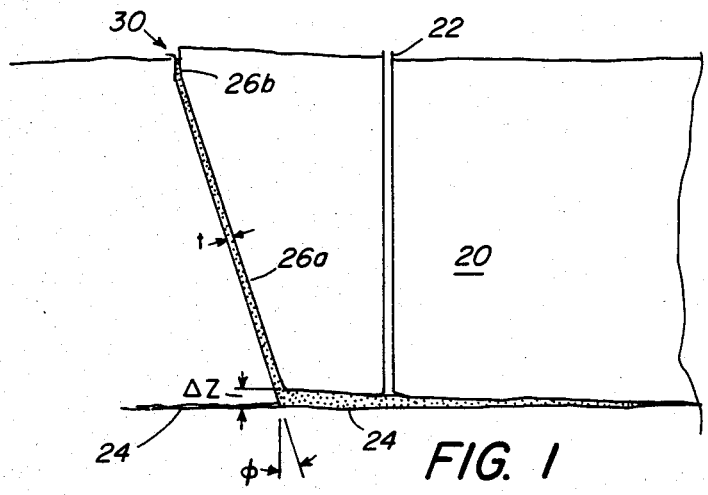
FIG. 1 is a cross-sectional view of an elevated earth block elevated with inclined separation.

FIG. 1 illustrates, in broad outline, the subject matter of the present invention. A block of earth 20, for example a block of contaminated earth, is displaced upward by pumping a sealant slurry into the underside of block 20 through injection wells 22. Displacement of block 20 creates a slurry filled separation 26*a* at the side. A vertial trench 26*b* forms the upper portion of separation 26 at the side of block 20. These slurry filled separations form barriers to the migration of contaminants, for example toxic materials, and the flow of ground water. Because of its inclination from vertical, separation 26*a* becomes wider as block 20 is displaced upward. This mechanism allows the formation of a thick barrier at the side of block 20 without the need to excavate the volume of the barrier.

A seal 30 is provided at the top of separation 26*b* to increase the pressure available to displace block 20 and increase the horizontal compressive stress in the block. Seal 30 may take several different forms as will be discussed in detail. Seal 30 allows a substantial greater pressure to be contained at the underside of block 20. The density and gel strength of the fluid filling separation 26*a* contributes to the displacement pressure available at the bottom of block 20. The presence of seal 30 reduces the density and gel strength required for fluid filling separation 26*a* during block 20 displacement.

The vertical displacement at the perimeter of block 20 of FIG. 1 is shown to be greater than the displacement in the bottom interior region. This non-uniform vertical displacement with attendant upward warpage at the perimeter of block 20 results in a more economical use of sealant in cases where the horizontal dimensions of the block are large relative to the depth of separation. The vertical displacement is concentrated at the perimeter of block 20 by directing a greater portion of sealant injection to wells 22 near the perimeter. This action, combined with the threshold flow resistance of the sealant due to its gel strength, results in upward warpage of the perimeter of block 20. The greater vertical displacement at the perimeter of block 20, combined with the inclination of separation 26*a*, provides the needed width of separation 26*a* to provide a barrier to horizontal flow.

For example, if the initial width of separation 26*a* is negligible, its width t due to vertical displacement of block 20 at the perimeter is:

$$t = \sin \phi \Delta z \quad (1)$$

where $\Delta z$ is the vertical displacement in the perimeter and $\phi$ is the angle of inclination of 26*a* from vertical. The thickness of separation 24 in the perimeter region is thus dictated by the thickness required for separation 26*a* and will normally be thicker than required for the bottom flow barrier. In the interior region, the vertical displacement is made sufficient to provide an adequate flow barrier. Thus, much less sealant is used than would be required for a uniform block displacement.

Figure 2:
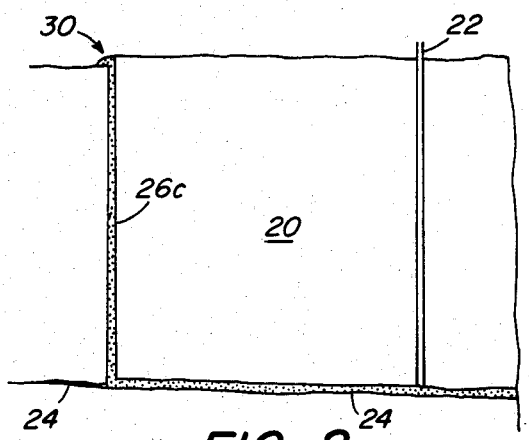
FIG. 2 is a cross-sectional view of an elevated earth block with vertical separation.

Non-uniform vertical displacement is particularly appropriate in cases where, before block movement, the separation 26*a* is very narrow (for example, separations formed by drilling, jetting and fracturing). In such cases, adequate thickness of sealant in separation 26 is achieved by angling the separation 26 from vertical and displacing the perimeter of block 20 vertically. In the embodiment of FIG. 2, the thickness of sealant in separation 26*b* does not depend on vertical displacement.

FIG. 2 illustrates a vertically displaced block 20 of overburden where a separation 26*c* is formed by excavating a vertical trench extending to the bottom of the block and filling the trench with sealant. The sealant filled trench forming separation 26*c* may be created by various means well known to those skilled in the slurry trenching art. Separation 26*c* is formed by excavation with adequate width to provide an efficient barrier to ground water flow and toxic waste migration. Since it is substantially vertical, its width does not depend on vertical block displacement. The vertical displacement is therefore based on the requirements for adequate thickness of barrier at the base of block 20 and economic considerations. The embodiment of FIG. 2 may also be provided with seal 30 in the top of separation 26*b*. Seal 30, as described in connection with FIG. 1, increases the displacement pressure available to lift block 20 and increases the horizontal stress in the block. The increased horizontal stress increases the stability of block 20, which will frequently be unconsolidated, and improves control in propagating the separation at the base of the block.

Seal 30 may be constructed in a number of ways. Generally, seal 30 should be established in the narrow vertical trench of moderate depth which forms separation 26*b*. Efficient methods are widely available for excavating such a trench with good control over position and geometry. For example, a chain saw type trenching machine may be used to form separation 26*b*.

Seal 30 may also be used in vertical trench 26*c*. Such a trench formed by conventional slurry trenching techniques will generally be much wider than 26*b*, making sealing more difficult. The advantages of forming seal 30 in narrow vertical cut trench 26*c* are the good control over geometry obtainable and the fact that vertical block movement does not produce divergence of the two sides of the trench.

In cases where an excavated vertical trench type separation is created at the side of block 20, such as shown in FIG. 2, at times, it is preferred to create an initial bottom separation, for example 2 cm thick, before completing separation 26. This procedure makes it easier to contain the fluid which is injected for initial separation of the base of block 20.

Figure 3:
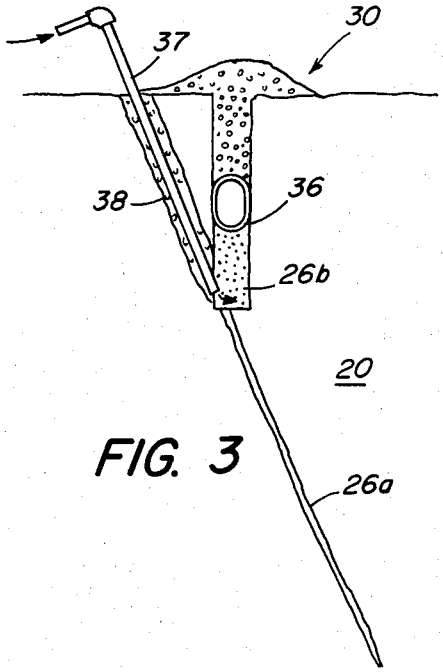
FIG. 3 is a cross-sectional view of an elevated block with a seal at the upper end of the lateral separation.

FIG. 3 illustrates a method for sealing separation 26*c*. A flexible hose 36 is placed in separation 26*c* at least several trench widths below the top of separation 26*c*

(or separation 26b). The diameter of hose 36 is substantially greater than the width of separation 26b. Water pressure is applied to hose 36, expanding it against the sides of separation 26b, and a surcharge of earth is heaped on top of it. Preferably, the column of earth inside separation 26b and above hose 36 is compacted.

FIG. 3 shows injection pipe 37 extending into separation 26b below 36. Pipe 37 enables sealant to be injected directly into separation 26b. Such injection can be useful in the initial stage of block separation and movement as will be explained in greater detail. Pipe 37 of FIG. 3 is cemented in one of the angle drill holes 38 drilled in the process of forming separation 26a. Inclined separation 26a can be initiated in various ways. One set of methods involves the extension of kerfs from angled bore holes. Jetting and broaching are kerf cutting methods that may be used. When vertical trench 26b is used, the angled entry holes are plugged with compact earth or cement from the surface to near the bottom of 26b.

Figure 4:
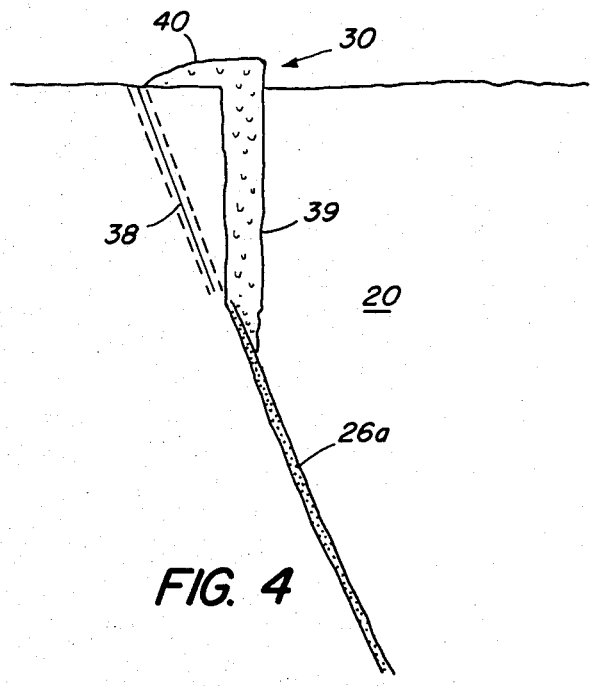
FIG. 4 is a cross-sectional view of an elevated block with an alternate embodiment of a seal at the upper end of the lateral separation.

FIG. 4 illustrates a seal formed by filling separation 26c with concrete and providing a low friction surface 39 on one side of a concrete wall 40. The sliding surface 39 is preferably provided on the moving block side, in which case the wall 40 remains stationary. The sliding surface may be conveniently provided by a thin, well oiled sheet metal form (not shown) placed on the moving block side of separation 26b. The sheet metal may be withdrawn and reused to form succeeding sections of wall 40. A surcharge of earth may be used as an added precaution against the movement of wall 40. The seal of FIG. 4 relies on narrow clearance combined with gel strength and particle bridge forming tendencies of the injected sealant.

Seal 30 may be established simply by packing separation 26b with paste sealant having an especially high gel strength. The pressure, ΔP, that can be sustained by such a seal is given by $$\Delta P = \rho_s g h + (Z\tau h/w) \quad (2)$$

where $\rho_s$ is the density of the sealant
h is the depth of the trench
w is the width of the trench and
$\tau$ is the gel strength of the sealant For example, let $\rho_s = 1500$ kg/m$^3$
h = 3 m
w = 0.1 m and,
$\tau = 1000$ Pa (0.145 psi)

Then from (2)

ΔP = 104,000 Pa (15 psi)

On the basis of equation (2) more pressure can be contained if the width w is less. This is also true for another reason. The upward thrust and the outward thrust of the gelled sealant on the sides of the trench must be resisted by the weight and strength of the soil on either side of the trench. Therefore, separation 26b should generally be as narrow as can be conveniently excavated.

Figure 5:
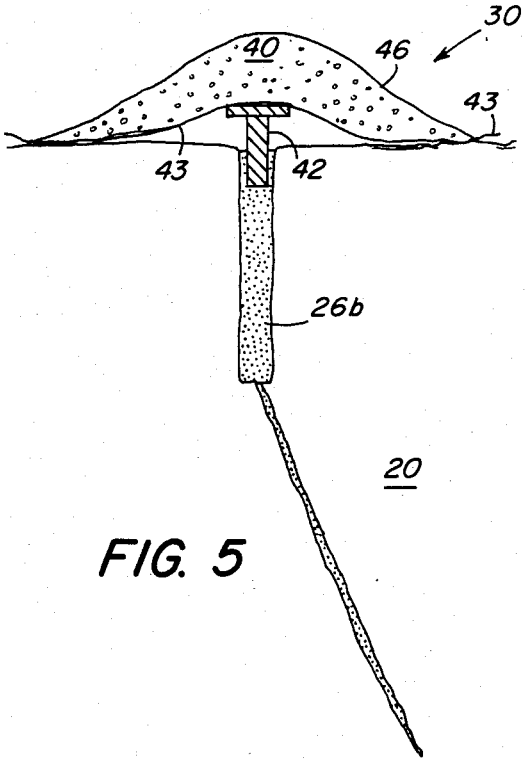
FIG. 5 is a cross-sectional view of an elevated block with a second alternate embodiment of a seal at the upper end of the lateral separation.

FIG. 5 illustrates a method for greatly increasing the resistance of the gelled sealant filling separation 26b. A T beam 42, which may be constructed of wood planking, is stabbed into the top of separation 26b and a plastic film 43 is stretched out over the top of T beam 42. A surcharge of earth 46 is then placed on top of plastic film 43. The weight of the earth is thus concentrated on the column of sealant in separation 26b. A surcharge of earth may be used to strengthen all of the sealing concepts previously discussed.

Seal 30 contributes to the efficiency and reliability of the block displacement operation in several ways. Seal 30 increases the maximum pressure that can be contained at the underside of block 20 during its displacement and increases the stabilizing horizonal stress applied to the block during displacement. Seal 30 also provides a means for increasing the horizontal stress before block displacement. Such a horizontal stress increase improves control over propagation of the pressure induced separation 24 which defines the bottom of block 20.

The increased horizontal stress resulting from injecting into separation 26a below seal 30 enables separation 24 to be propagated more reliably in the desired horizontal plane defining the bottom of block 20.

Propagation of separation 24 and initial block 20 displacement, that is the first few centimeters of displacement, are preferably carried out with a slurry having a relatively low solids content and gel strength, and very low leak-off properties. Such a fluid requires much less pressure in propagating and widening narrow openings than the high solids sealant material typically injected in later stages of block displacement. The low solids fluid will also invade and lubricate separation 26a more efficiently in the initial stages. The disadvantage of the low solids slurry injection in the eary stage is that its movement up separation 26a makes less pressure available for block displacement. The pressure available to separate the bottom of the block and begin block displacement depends on the hydrostatic column pressure and resistance to flow up the separation 26a. Thus, seal 30 provides the additional pressure needed to begin block displacement when the low solids fluid, which is used to separate the base of the block and start upward block displacement, provides less flow resistance and hydrostatic column pressure in separation 26a than is needed to begin block displacement.

One component of the present invention is a novel method for creating a sealant filled hydraulic separation across the base of a region to be isolated. It is very difficult to create a hydraulic separation following a controlled horizontal path in permeable unconsolidated sand and gravels by conventional techniques.

Many sites with underground toxic waste contamination are located in flood plain deposits and similar deposits of predominantly sands and gravels with high permeability. Creating separation 24 under the contaminated region in highly permeable unconsolidated materials can be a special problem if interbedding of low permeability silt and clay is absent.

In cass where the high permeability strata are interbedded with low permeability silt or clay, a bedding plane separation can be propagated by 'spearheading' the injection with a high leak-off fluid such as plain water. The water injection is then followed by a low leak-off filter cake building fluid to widen and extend the separation. The spearhead of water injection tends to propagate the separation within the more permeable bed.

If the sediments have high horizontal and vertical conductivity, the above strategy will not be satisfactory. Very high rates of water injection are then required to initiate and extend the separation. Injected water would flow upward into the contaminated region causing migration of contaminants.

Another approach to the problem is to inject from the beginning a low leak-off filter cake building fluid, extending the separation from a deep horizontal notch. In this way, water invasion of the contaminated region is held to a low level. This procedure can be satisfactory in some geologic settings, but in many others it is unsatisfactory.

The extension of a separation in permeable unconsolidated sediment with a low leak-off filter cake building fluid can be characterized as follows: The pressure required to initiate and extend the separation is relatively high, that is, substantially higher than the overburden pressure, and much higher than required for a penetrating fluid such as water. The initiation pressure can be excessively high for the low leak-off fluid unless the horizontal notch is deep enough and sharp enough. This last problem arises from a local deformation and stress adjustment in the sediment opposing the separation. After the separation is initiated, formation of filter cake within the separation in highly permeable sediment tends to block flow. Excessive extension pressure may result in flow blockage by filter cake and plastic yielding of the sediments. Excessive initiation and extension pressures increase the chances of channeling to the surface and diversion of the separation along an unwanted path. The filter cake building fluid also has less tendency than a penetrating fluid to extend the separation along the more permeable zone, even in the absence of excessive extension pressure.

The above problems can be controlled in many situations by cutting a sufficiently deep notch, careful design of fluid properties, and control of injection rate. These problems become more difficult to control in coarser more permeable sediments.

The present invention provides a method for avoiding these problems in coarse grained highly permeable sediments by providing a method for extending a horizonal separation in gravel interbedded with permeable sand, or in coarse sand interbedded with finer sand. Cutting a deep notch in coarse unconsolidated sediment can be a problem. The method now to be described does not require a notch, although a notch or hole enlargement is still beneficial if hole collapse can be avoided.

The horizontal separation method of the present invention is preferably performed before perimeter separation 26*a* (or separation 26*c*) has been completed. By deferring completion of separation 26, the problem of controlling the escape to the surface of fluid injected to form separation 24 is avoided. There also may be an advantage in deferring the choice of location for separation 26 until after the creation of separation 24 if more information becomes available during this operation concerning the extent of the contaminated region. A preferred embodiment of the method of the present invention for creating separation 24 under the contaminated region will be understood from the following discussion with reference to FIGS. 6 and 7.

FIG. 6 is a cross section through the contaminated region. Relatively coarse grained lenticular sand or gravel body 50 is the zone selected for separation 24. Bed 50 is bounded above and below by beds of finer grained sand. Cased wells 22 open conductively into bed 50. In the first stage of the operation, certain wells 22*a* are designated injection wells and certain wells 22*b* are withdrawal wells.

A specially designed "small particle low leak-off fluid" (SPLL fluid) is prepared containing a small percentage of sodium bentonite (i.e. 1 to 5%) and a small percentage of CMC (0.1 to 0.3%). A small percentage of silt sized particles may be added to this mixture in cases where bed 50 is a gravel bed enclosed by coarse sands. The SPLL fluid is tailored so that is can move freely through the porosity of bed 50 and initiate filter cake formation when it encounters a substantially finer grained material. The SPLL fluid is carefully mixed and screened to eliminate larger particles from suspension. Care must be taken to eliminate undispersed agglomerations of bentonite and CMC.

In the example of FIG. 6, the SPLL fluid is injected into a centrally located well 22*a* while water is withdrawn from wells 22*b* near the perimeter of the contaminated region. Water withdrawn from wells 22*b* is used to mix the SPLL fluid injected into well 22*a*. The rate of withdrawl from wells 22*b* is regulated to prevent pressure increases in bed 50 and minimize vertical flow into the contaminated zone. The injection and withdrawal operation is continued until bed 50 has been flooded by SPLL fluid in the contaminated region and the SPLL fluid begins to exit from wells 22*b*. When the SPLL fluid flows from wells 22*b*, a second stage of injection is initiated.

In the second state of injection, withdrawl from wells 22*b* is stopped and a gelled SPLL fluid is selectively injected into these wells. Injection continues into 22*a* and the pressure in bed 50 increases progressively. The buildup of pressure throughout bed 50 is made possible by the formation of intergranular filter cake along transitions to the smaller grain size of sediments enclosing bed 50. As the pressure in bed 50 increases, the SPLL fluid tends to flow upward and downward until it encounters a material having substantially smaller grain size. Even a very thin layer having substantially smaller grain size acts as a barrier to vertical flow. When the formation of an intergranular filter cake is initiated, conductivity through the cake diminishes rapidly as the cake thickens. Generally, the permeability of the bentonite CMC cake is on the order $2\times10^{-8}$ cm/sec.

FIG. 7 is a cross-sectional view through bed 50. SPLL fluid flows into bed 50 and blocks its own escape into the finer grained strata above and below the bed by forming intergranular filter cake 52 in these finer grain strata. The SPLL fluid thus introduces permeability stratification.

If bed 50 pinches out in a short horizontal distance, the intergranular filter cake will contain pressure at the perimeter. If coarse grained bed 50 extends horizontally well beyond the perimeter of the contaiminated region, pressure is contained at the perimeter of the contaminated region by injecting a gelled SPLL fluid into wells 22*b* in the perimeter region. For example, 4% bentonite in water may yield a gel strength of 7 Pa (0.001 psi), while the gel strength of 2% bentonite in water is substantially zero. The 4% bentonite fluid builds a substantial static flow resistance in a coarse grained porous sediment. Thus, injection of low gel strength SPLL fluid around the perimeter blocks escape of SPLL fluid of negligible gel strength injected in the interior region.

With SPLL fluid confined to bed 50 under the contaminated region, continued injection through wells 22*a* increases the pore pressure until it approximately equals the overburden pressure. With continued injection, separation 24 opens progressively, starting near the injection wells, and spreads over the entire area of bed 50 containing the injection pressure. Separation occurs near the top of bed 50 just below the intergranular filter cake formed by the SPLL fluid. The existence of the opening separation can be confirmed by observing that the bottom hole injection pressure no longer increases, but rather holds constant and approximately equals the overburden pressure computed for the depth of separation. Preferably, the progress in opening of separation 24 is monitored by repeated level surveys at the surface.

After separation 24 has been opened over substantial distances, and vertical displacements greater than 1 cm have been measured in the vicinity of the injection walls, sealant containing progressively higher quantities of mineral solids and having a progressively higher gel strength is injected into separation 24, further widening it.

Sealant injection continues until separation 24 is sufficiently wide over the contaminated region to eliminate the danger of flow blockage due to filter cake formation. Generally, a separation width of 0.1 m is sufficient for this purpose. Surface level measurements are used to monitor the displacement of the contaminated region and direct injection to wells where the separation is thin.

As discussed earlier, in certain cases, it is preferred that separation 24 be extended under the contaminated region and widened to a significant thickness of injected sealant before separations 26 have been completed at the sides of the contaminated region. In these instances, separations 26 are completed after a high gel strength sealant has been injected into 24. The gel strength of the sealant is sufficiently high to insure that subsequent injection into separation 24 will not be impeded by filter cake after separations 26 have been completed. If the perimeter separation is of the inclined type 26*a*, injection into wells 22*b* near the perimeter of block 20 is resumed after completion of the separation 26*a*. The perimeter of block 20 is thus displaced upward until wells 22*b* have been sufficiently widened with sealant to form an adequate flow barrier (see FIG. 1) around the sides of block 20. Injection in the interior is also continued until an adequate barrier thickness is established across the bottom of block 20 in separation 24.

All or portions of the perimeter separation 26 may be of the conventional slurry trench type 26*c* which does not require widening by block displacement. In this case, injection of sealant through wells 22 is continued, displacing block 20 upward until separation 24 reaches adequate thickness for bottom sealing as shown in FIG. 2.

The novel bottom separation process discussed with reference to FIG. 6 is applicable to a variety of geologic settings. For example, the coarse grained zone in which separation 24 is initiated may comprise disconnected lenses of gravel or coarse sand distributed at roughly the same depth under a wide area of contamination. Some wells 22 would bottom in the coarse grained material, some would bottom in the finer grained material. Wells 22 in the fine grained material would be designated withdrawal wells to balance the volume injected and minimize displacement into the contaminated zone during initial injection of SPLL fluid.

Another common setting for an area of underground contamination is a layer of unconsolidated sediments covering hard fractured basement rock, where the material at the base of the sedimentary layer and covering the basement rock is coarse grained. The separation may then be introduced with the SPLL fluid as described before. The lower intergranular filter cake would form on the fractured basement rock, blocking the entries to the fracture system. It is to be noted that the bottom separation method described herein creates three horizontal barriers to flow. The upper and lower intergranular filter cakes, and the main sealant filled separation adjacent the upper intergrannular cake.

Preferably, the SPLL fluid is tailored to a particular sedimentary section by laboratory test. For example, in the case of a clean gravel enclosed by a coarse sand, a small percentage of silt sized particles are added to the bentonite CMC slurry to help initiate formation of filter cake on the sand. In the case of a coarse to a medium sand enclosed by fine sand, care is taken to eliminate silt sized particles in the suspension and to disperse the bentonite and CMC as fully as possible so that the SPLL fluid is capable of flowing through the medium sand. If the grain size of bed 50 is too small (at the lower end of the medium size range), well dispersed bentonite will not pass through the bed. A SPLL fluid containing only CMC is used if bed 50 is enclosed by fine sand or silt.

Progressive block displacement is another novel aspect of the present invention. In many instances, especially in cases where the contaminated area is large relative to the depth of contamination, it is a great advantage to perform the block displacement in a progressive manner. That is, in progressive displacement, vertical displacement begins in a particular area of the block and moves along a proscribed path by shifting the points of injection along this path. This process of progressive displacement in which a given path, of necessity, involves bending in the block. The progressive displacement is programmed so that bending is gradual and the bending stresses are small.

In an earlier discussion, an aspect of progressive displacement is discussed. Bottom separation 24 is initiated over the area under the contaminated region before completion of separation 26*a* at the sides of block 20. Separation 26*a* is then completed and the perimeter of block 20 is displaced a sufficient distance to open 26*a* to an adequate barrier thickness. Another aspect of progressive displacement, which is the subject of the present invention, is the progressive displacement of block 20 along the length of separation 26. Progressive displacement along separation 26 can be considered in two contexts. In one context, the block to be displaced covers a broad area and vertical displacement is effected along a path following separation 26 around the perimeter of the block. In the second context shown in FIG. 8, a broad area of waste contamination is isolated by displacing a narrow black having a trapezoidal cross section where the long axis of the block follows the perimeter of the contaminated region. In this case, there are two separations 26*a* which follow parallel paths around the perimeter of the contaminated region.

FIG. 9 is a sectional view in the plane of separation 26*a*. A mobile drilling unit advances along the projected path of separation, drilling separation holes 38 and widening the holes with a slot cutting device. The slots may be cut by hydraulic jetting. Stability of the slotted holes 38 is maintained by keeping them filled with a low leak-off mud slurry. In the example shown in FIG. 9, separation 26*a* is formed initially by creating closely spaced mud filled notched holes 38 and cutting vertical trench 26*b* on the block 20 side of separation 26*a*, trench 26*b* intersecting separation 26*a* as shown in cross section in FIG. 3. The next step is to introduce seal 30 into trench 26*b*. In the example shown in FIGS. 3 and 9, seal 30 consists of hose 36 which is placed into the bottom of separation 26*b* and put under pressure. Trenches 26*b* are then filled with earth. The final operation to complete separation 26a is the displacement of block 20. Displacement along block 20 is effected by injection of fluid into a succession of wells 22 which are spaced along a line adjacent separation 26. Preferably, the separation at the base of block 20 has been completed in the vicinity of the section of separation 26a about to be completed by vertical block displacement. In the case illustrated in FIG. 8, where an elongate trapezoidal section block 20 is being displaced, injection takes place into successive holes spaced along the center of the block.

In some cases, separation 26b is completely severed in the initial cutting operation and is widened during block displacement. In other cases, separation 26b is initially discontinuous, a shown in FIG. 9 and is completed by combined shear and tension when block 20 is displaced. It is generally more economical to form an initially discontinuous separation 26b. The progressive displacement method enables selection of optimum spacing for holes 38 which are placed very close together at the beginning of the operation to form separation 26b with a continuous or nearly continuous cut. The spacing of holes 38 is then increased incrementally until the most economical spacing is discovered. The most economical spacing is the widest spacing that does not materially affect the quality of the separation or the reliability of the operation.

In cass where separation 26b is completed by the displacement of block 20, a number of important factors influence the mechanism whereby the separation is completed. The mechanism for completing the separation is a combination of shear and tensile strains due to displacement of block 20 concentrated in the uncut area. A tensile stress component is also applied to the uncut area between slotted holes 38 by the fluid pressure within the holes. Therefore, seal 30 aides the separation process to the extent that it allows the pressure within holes 38 to be increased. As discussed earlier, this pressure can be increased by direct injection into the underside of seal 30 through holes 38 (FIG. 3).

If the pressure in separation 26b exceeds the horizontal earth stress, a tensile strain becomes concentrated in the uncut areas between holes 38. In the lower portion of separation 26a, the strain due to the pressure in 26a tending to separate the uncut areas is much greater if separation 24 has already been formed and injected with at least a thin layer of sealant. The presence of separation 24 eliminates shear restraint at the base of block 20. Fluid pressure within separation 26a can then effect horizontal strains in block 20 to open separation 26a.

The progressive displacement process is particularly efficient in severing the uncut areas between holes 38. With progressive displacement, the shear area at the sides of the block that is effective in resisting block displacement is small. The shear load due to block displacement tends to concentrate on successive unfailed areas between holes 38. This load concentration effect is most pronounced in the presence of cohesive strata. The effect of progressive displacement on the separation of uncut areas between holes 38 is analogous to tearing along a line of perforations or shearing a plate where the blade makes an angle to the back up plate so that the point of shear progresses along the plate. The progressive shearing of the uncut areas between holes 38 is indicated in FIG. 9 by the dashed cross hatch.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A method for displacing a block of earth comprising the steps of:

(a) forming a separation along at least one side of a block to be displaced;

(b) forming a trench at an upper region of said separation;

(c) forming a passage to the bottom of said block;

(d) sealing an upper region of said separation, including pouring concrete into the top of said trench to form a seal and forming a vertical smooth low friction surface on the block side of said concrete seal within said trench; and (e) injecting a fluid into said separation and displacing the block.

2. A method for displacing a large block of earth material upwardly from its native position comprising the steps of:

(a) forming a series of passages which extend to the bottom of a block to be displaced, said passages disposed in a selected path;

(b) injecting a gelled sealant through said passages in a selected sequence along said path; and (c) progresively displacing the block in a series of vertical displacements which advance progressively along said path, said region of displacement following the perimeter of the block, the vertical displacement of the perimeter being greater than the displacement in the interior region of the block.

3. A method for displacing a large block of earth material upwardly from its native position comprising the steps of:

(a) forming a series of passages which extend to the bottom of a block to be displaced, said passages disposed in a selected path;

(b) injecting a gelled sealant through said passages in a selected sequence along said path;

(c) progressively displacing the block in a series of vertical displacements which advance progressively along said path; and (d) forming a separation at the base of the block over the underside of the area to be isolated with more than 2 cm vertical displacement before forming a separation at the side of the block.

4. A method for displacing a block of earth comprising the steps of:

(a) forming a passage to a region at the bottom of a block to be displaced;

(b) injecting a fluid into said passage and displacing said block upwardly while maintaining the integrity of the perimeter of the block;

(c) forming a separation at the perimeter of the block; and (d) injecting a fluid into said passage and upwardly displacing the block so that the block is further displaced upwardly relative to the earth materials immediately adjacent said separation outside of the block, the upward displacement of the perimeter of the block being greater than the displacement in the interior of the block.

5. A method for displacing a block of earth comprising the steps of:

(a) forming a separation along at least one side of a block to be displaced;

(b) forming a trench at an upper region of said separation;

(c) forming a passage to the bottom of said block;

(d) sealing an upper region of said separation and placing a fluid sealant in said trench, said sealant having a gel strength which is greater than 500 Pa, increasing the resistance of said sealant in said trench by placing a beam in the top of said trench, placing a sheet of material over the top of said beam, and placing a surcharge of earth on said sheet of material; and (e) injecting a fluid into said separation and displacing the block.

* * * * *